US007665865B1

(12) United States Patent
Hulse et al.

(10) Patent No.: US 7,665,865 B1
(45) Date of Patent: Feb. 23, 2010

(54) LIGHTING SYSTEM WITH COLOR ADJUSTMENT MEANS

(75) Inventors: George R. Hulse, Arlington Heights, IL (US); Lloyd S. Wilkiel, Westchester, IL (US)

(73) Assignee: iLight Technologies, Inc., Chicago, IL (US)

( * ) Notice: Subject to any disclaimer, the term of this patent is extended or adjusted under 35 U.S.C. 154(b) by 136 days.

(21) Appl. No.: 11/829,342

(22) Filed: Jul. 27, 2007

Related U.S. Application Data

(60) Provisional application No. 60/821,047, filed on Aug. 1, 2006.

(51) Int. Cl.
*F21S 8/00* (2006.01)

(52) U.S. Cl. ..... 362/277; 362/293; 362/311.02

(58) Field of Classification Search ..... 362/18, 362/277, 293, 311.01, 311.02, 311.13, 311.14, 362/351, 355, 356
See application file for complete search history.

(56) References Cited

U.S. PATENT DOCUMENTS 4,291,365 A * 9/1981 Tandon et al. ..... 362/281
4,556,932 A * 12/1985 Lehrer et al. ..... 362/103
5,144,540 A * 9/1992 Hayes ..... 362/268
7,011,421 B2 3/2006 Hulse et al.
7,178,926 B2 2/2007 Hulse
7,186,005 B2 3/2007 Hulse
7,192,161 B1 3/2007 Hulse et al.
7,207,692 B1 4/2007 Hulse et al.
7,241,039 B2 7/2007 Hulse
7,264,366 B2 9/2007 Hulse
7,264,367 B2 9/2007 Hulse
2002/0140348 A1* 10/2002 Takeuchi et al. ..... 313/581
2007/0133204 A1 6/2007 Hulse et al.

* cited by examiner

*Primary Examiner*—Sandra L O'Shea
*Assistant Examiner*—Jason Moon Han
(74) *Attorney, Agent, or Firm*—Stites & Harbison, PLLC; David W. Nagle, Jr.; Jeffrey A. Haeberlin

(57) ABSTRACT

A lighting system include a point light source, a tubular color adjustment means, and a light-collecting and mixing element. The color adjustment means has a color-converting tubular structure and an adjusting rod. The tubular structure is made of a light-transmitting medium doped with a wavelength-converting material. The adjusting rod is operably connected to and for adjusting the tubular structure. In operation, the point light source emits light of a first wavelength or hue. The color adjustment means adjustably intersects, through the use of the adjusting rod, the light of the first hue and converts at least a portion of the light of a first hue into a light of another hue. The light-collecting and mixing element collects and mixes the light of a first hue and the light of another hue, and directs the mixed light out the open end.

10 Claims, 7 Drawing Sheets

LIGHTING SYSTEM WITH COLOR ADJUSTMENT MEANS

CROSS-REFERENCE TO RELATED APPLICATIONS

This application claims priority to U.S. Provisional Patent Application No. 60/821,047, filed Aug. 1, 2006, the entire disclosure of which is incorporated herein by reference.

BACKGROUND OF THE INVENTION

It is desirable to adjust the color of lighting systems utilizing point light sources, including light-emitting diodes (LEDs), metal halide light sources, and ultraviolet light sources, for general and task illumination on a widespread basis. However, a problem with many point light sources is that the available visible color spectrum of light produced by the point light sources is limited. For instance, LEDs are available only in limited colors. Therefore, in commonly assigned U.S. Pat. No. 7,011,421, and in commonly assigned and co-pending U.S. patent application Ser. No. 11/025,019, each of which is incorporated in its entirety herein by this reference, illumination devices are described that use fluorescent and/or phosphorescent dyes, thus allowing for emission of light in colors that cannot ordinarily be achieved by use of LEDs alone without a significant increase in cost or complexity of the illumination device. However, it is desirable to be able to easily adjust the color of the light emitted by such illumination devices.

SUMMARY OF THE INVENTION

The present invention is a lighting system with a color adjustment means in which a desired hue can be achieved and finely tuned through use of the color adjustment means.

A first embodiment of a lighting system according to the invention includes a point light source, such as a light-emitting diode, having a base and emitting a light of a first hue, with the point light source further defining a central axis, and a color adjustment means. The color adjustment means includes a tubular structure and an adjusting rod. The tubular structure is made of a light-transmitting medium doped with a wavelength-converting material. The tubular structure is axially aligned with the point light source and intercepts at least a portion of the light emitted by the point light source such that the intercepted portion of the light of the first hue is converted to a light of another hue. The adjusting rod is operably connected to the tubular structure for adjusting the tubular structure toward or away from the base, such that the tubular structure adjustably intersects the light of the first hue.

In this first embodiment, the lighting system further includes a mixing element that is substantially cup-shaped and axially aligned with the point light source. The mixing element further has a closed end being proximate the point light source, an open end being distal the point light source, and a continuous side wall extending therebetween for collecting, mixing, and emitting light toward the open end.

In a second embodiment, the tubular structure includes a first portion doped with a first wavelength-converting material and a second portion doped with a second wavelength-converting material. By adjusting the tubular structure with respect to the point light source, different proportions of the first portion and the second portion of the tubular structure intersect the beam of the light emitted by the point light source. The first portion and the second portion of the tubular structure may have mating, triangular cross-sectional profiles.

Generally described, in this second embodiment, the color adjustment means of the lighting system also includes a retaining ring having an end proximate the base. The retaining ring is made of a light-transmitting material, is axially aligned with the point light source, and further houses the tubular structure for guiding the tubular structure as it is moved towards or away from the base. The retaining ring may be clear, or it may be frosted to aid in the mixing of the light.

Furthermore, in this second embodiment, the lighting system can include a retaining ring cover connected to a distal end of the retaining ring for limiting a travel of the tubular structure.

As a variation of the second embodiment, the tubular structure can include a color-converting ring formed of a plurality of light-transmitting rods arranged side-by-side. At least one of the light-transmitting rods is doped with a first wavelength-converting material and at least one of the light-transmitting rods is doped with a second wavelength-converting material. The rods can alternate in the first wavelength-converting material and the second wavelength-converting material. The tubular structure can also include a reflector disk connected to a distal end of the color-converting ring.

As another variation of the second embodiment, the tubular structure can also include a plurality of light-transmitting wedges arranged side-by-side, wherein at least one of the light-transmitting wedges is doped with a first wavelength-converting material and at least one of the light-transmitting wedges is doped with a second wavelength-converting material.

Another variation of the second embodiment includes a tubular structure having a plurality of light-transmitting toroids arranged adjacent each other. At least one of the light-transmitting toroids is doped with a first wavelength-converting material and at least one of the light-transmitting toroids is doped with a second wavelength-converting material.

In yet another variation of the second embodiment, the tubular structure can include a color-converting ring formed of a plurality of light-transmitting rods arranged side-by-side to form the tubular structure and a reflector disk connected to an end of the color-converting ring distal from the base. At least one of the rods can be of a first length, at least one of the rods can be of a second length, and at least one of the rods can be of a third length, such that the rods can be in a staggered arrangement so that a portion of the light from the point light source can escape without passing through the color adjustment means.

In a third embodiment, the color adjustment means includes a first color-converting ring, a second color-converting ring, and a first reflector disk. The first color-converting ring has an end proximate the base and is further doped with a first wavelength-converting material. The first color-converting ring is axially aligned with the point light source. The second color-converting ring has an end proximate the base. The end proximate the base is operably connected to the adjusting rod. The second color-converting ring is doped with a second wavelength-converting material and is concentric and axially aligned with the first color-converting ring.

Further, the first color-converting ring can be formed of a first plurality of light-transmitting rods arranged side-by-side, and the second color-converting ring can be formed of a second plurality of light-transmitting rods arranged side-by-side.

The fourth embodiment of the present invention includes a light-emitting diode (LED) having a light-emitting portion for emitting light of a first hue and defining a central axis and a color adjustment means. The color adjustment means includes a first light-transmitting tubular structure, a helical fiber, a means of adjusting a position of the tubular structure relative to the LED, and a means of adjusting a compression of the helical fiber.

The light-transmitting tubular structure is axially aligned with the LED and is doped with a first wavelength converting material. The helical fiber has a diameter that is larger than a diameter of the first tubular structure. The helical fiber is positioned around and aligned axially with the tubular structure and is doped with a second wavelength converting material.

A portion of the light emitted by the LED passes through the tubular structure and is converted to a light of another hue. A portion of the light emitted and a portion of the light of another hue pass through open spaces between the turns of the helical fiber. Another portion of the light emitted is received by the helical fiber and is converted to light of yet another hue.

Adjusting the position of the tubular structure relative to the LED and adjusting the compression of the helical fiber adjusts the percentages of the light emitted by the LED, the light converted by the first tubular structure, and the light converted by the helical fiber.

DETAILED DESCRIPTION OF THE INVENTION

The present invention is a lighting system with a color adjustment means in which a desired hue can be achieved and finely tuned through use of the color adjustment means.

For purposes of the discussion that follows, it is important to recognize that most perceived "colors" are not representative of light of a single wavelength, but rather some combination of wavelengths. In this regard, the dominant or perceived color of light comprised of some combination of wavelengths is generally referred to as hue. In order to provide a mechanism to represent and identify all possible perceived colors, the Commission Internationale l'Eclairage (CIE) constructed the CIE Chromaticity Diagram, which is based on three ideal primary light colors of red, blue, and green. The CIE Chromaticity Diagram is a well-known tool for identifying colors and is well understood by one of ordinary skill in the art. Specifically, since the x-axis of this CIE Chromaticity Diagram represents the amount of ideal red that would be mixed with ideal blue, and the y-axis of the CIE Chromaticity Diagram represents the amount of ideal green that would be mixed with ideal blue, a desired color can be identified in terms of its x and y coordinates. It is also important to recognize that the chromaticity curve, which is representative of the visible spectrum, is commonly superimposed over the chart such that wavelengths within the visible spectrum are represented along this curve.

Furthermore, the CIE Chromaticity Diagram is also helpful in understanding mixtures of primary light colors. Specifically, if a straight line is drawn between two points on the chromaticity curve, for example from green with a wavelength of 510 nm to red with a wavelength of 700 nm, that straight line illustrates the range of colors that could be created and perceived by the human eye, depending on the relative amounts of primary light colors in the mixture, including various yellowish-green colors and oranges. It is also important to recognize that the central region of the CIE Chromaticity Diagram is representative of white, a combination of the three ideal primary light colors. If any straight line between two colors on the chromaticity curve passes through this central region, those two colors can be mixed to create a perceived white color.

Figure 1:
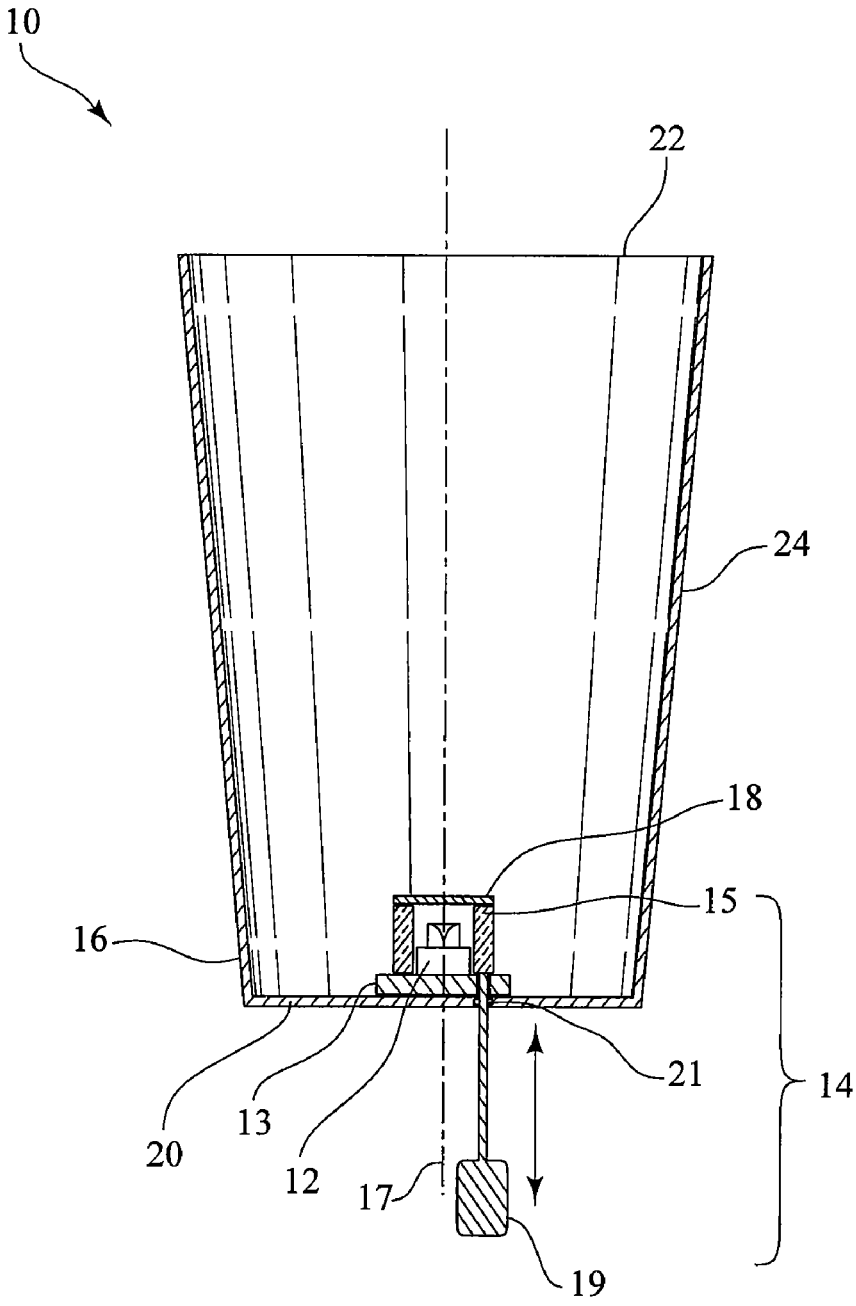
FIG. 1 is a partial side-sectional view of a first exemplary embodiment of a lighting system according to the invention.

Returning to the present invention, FIG. 1 is a partial side-sectional view of a first exemplary embodiment of a lighting system 10 according to the invention. The lighting system 10 includes a point light source 12, a color adjustment means 14, and a light-collecting and mixing element 16.

In this first exemplary embodiment, the point light source 12 is a side-emitting LED having a base 13. The LED 12 further defines a central axis 17 of the lighting system 10. Not shown, but known in the art, are components for operating the LED 12, including electrical wiring for supplying power to the LED 12, and any necessary heat sink elements for dissipating heat from the LED 12. Although a side-emitting LED is described with respect to this first embodiment, it is important to recognize that the point light source could also be another type of LED (e.g., Lambertian and/or Batwing LEDs), a metal halide light source, an ultraviolet light source, or another known light source without departing from the spirit or scope of the present invention.

In this first exemplary embodiment, the color adjustment means 14 has a color-converting tubular structure 15 and an adjusting rod 19. The color-converting tubular structure 15 is an annulus or ring made of a light-transmitting medium doped with a wavelength-converting material, such as a phosphorescent and/or fluorescent dye or pigment. The adjusting rod 19 is operably connected to the tubular structure 15 for adjusting the tubular structure 15 toward or away from the base 13. The tubular structure 15 has an end proximate the base 13 and an end distal from the base 13, and is further axially aligned with and around the central axis 17 of the LED 12, such that light of a first hue emitted by the LED 12 will be intercepted by the tubular structure 15, and at least a portion of the light emitted by the LED 12 will be converted to a light of another hue by the wavelength-converting material. By using a phosphorescent and/or fluorescent dye or pigment, or combinations thereof, as the wavelength-converting material, the conversion of the light to a light of another hue is accomplished very efficiently, as opposed to a typical color filter which accomplishes a color change by blocking the undesired wavelengths of the emitted light. Preferably, an LED 12 emitting light having a relatively short wavelength (relatively high energy) is chosen to allow excitation of the phosphorescent and/or fluorescent dye or pigment and emission of the light of another hue having a relatively longer wavelength (relatively lower energy).

Applicants have determined that one appropriate material for the light-transmitting medium is a plastic material, such as a polycarbonate or acrylic resin. When using such a material, the wavelength-converting material may be some predetermined combination of one or more fluorescent dyes, phosphorescent dyes, and/or other dyes or colorants that are mixed into the material.

Additionally, in this first exemplary embodiment, the lighting system 10 also has a reflector disk 18 connected to and covering the end of the tubular structure 15 distal from the base 13. The reflector disk 18 has a reflective surface facing the LED 12. The reflector disk 18 prevents light from escaping through the top of the tubular structure 15 and redirects it into the side, wavelength-converting portion of the tubular structure 15.

Finally, in this first exemplary embodiment, the light-collecting and mixing element 16 is cup-shaped and axially aligned with the central axis 17 of the lighting system and around the LED 12, the tubular structure 15 and the reflector disk 18. The light-collecting and mixing element 16 has a closed end 20, an open end 22, and a continuous side wall 24 extending therebetween. The interior surfaces of the continuous side wall 24 are preferably reflective. The closed end 20 is proximate the base 13 and defines an opening 21 for slidingly receiving the adjusting rod 19. There is a pressure fit for the adjusting rod 19 such that once a user uses the rod 19 to adjust the tubular structure 15 towards or away from the base 13, friction on the adjusting rod 19 prevents the rod 19, and correspondingly the tubular structure 15, from moving. Alternatively, the opening and the rod 19 can be correspondingly threaded for a threaded fit instead of a pressure fit. For a threaded fit, the rod 19 can be rotated in a clockwise or counterclockwise direction to adjust the tubular structure 15 towards or away from the base 13.

In operation, the LED 12 emits light of a first wavelength or hue. The color adjustment means 14 adjustably intersects, through the use of the adjusting rod 19, the light of the first hue and converts at least a portion of the light of a first hue into a light of another hue. The light-collecting and mixing element 16 collects and mixes both the light of a first hue and the light of another hue, and directs the mixed light out the open end 22. For example, the LED 12 may emit light having a wavelength in the blue region (short wavelength and relatively high energy) of the color spectrum, and the wavelength-converting material of the color adjustment means 14 may be an orange fluorescent dye, such that the mixed light approximates the hue and intensity of a conventional tungsten filament light source, i.e. white. Furthermore, to the extent that a white light is desired, the warmth of the light may also be adjusted.

Figure 2:
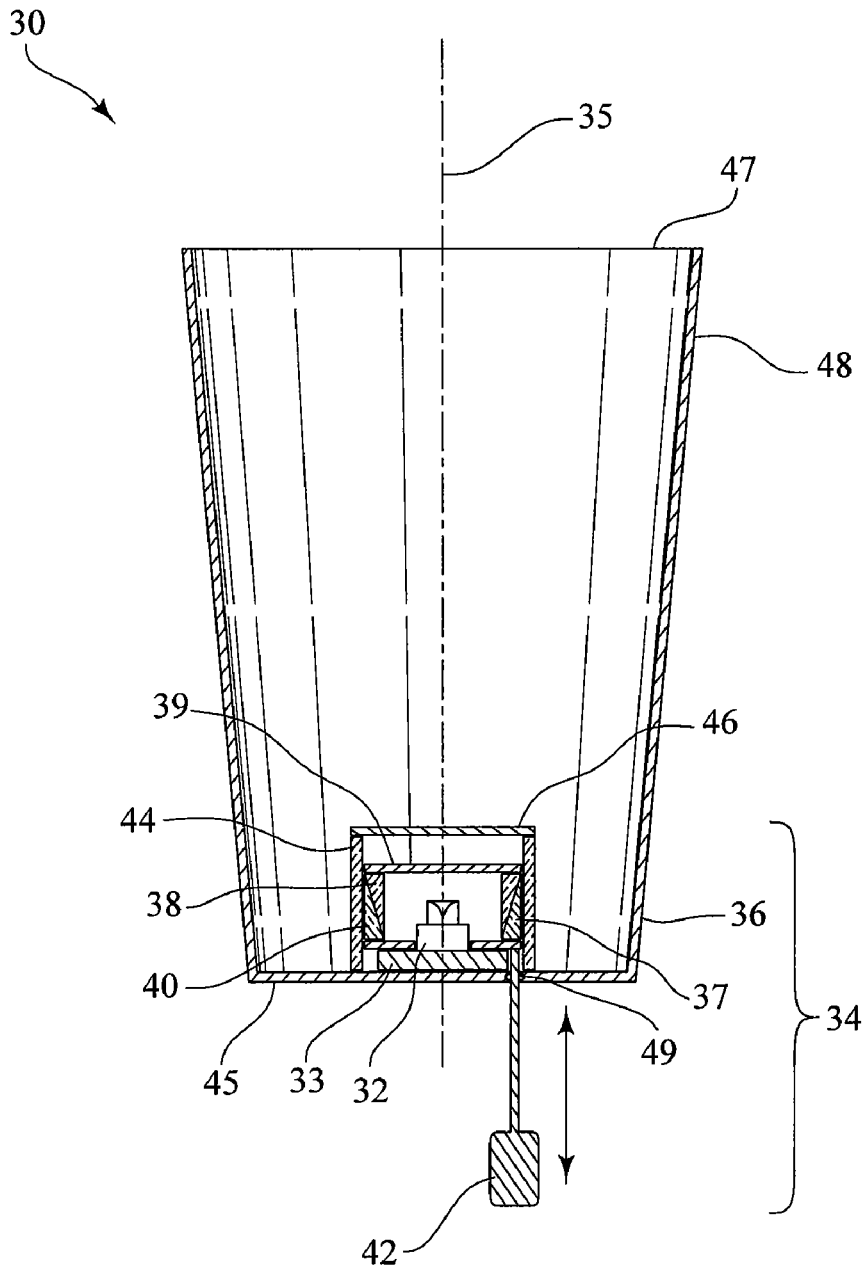
FIG. 2 is a partial side-sectional view of a second exemplary embodiment of a lighting system according to the invention.

FIG. 2 is a partial side-sectional view of a second exemplary embodiment of a lighting system 30 according to the invention. The lighting system 30 also includes a point light source 32, a color adjustment means 34, and a light-collecting and mixing element 36.

In this second exemplary embodiment, the point light source 32 is a side-emitting LED having a base 33. The LED 32 further defines a central axis 35 of the lighting system.

In this second exemplary embodiment, the color adjustment means 34 has a color-converting tubular structure 37 and an adjusting rod 42. The tubular structure 37 has an end proximate the base 33 and an end distal from the base 33 and is further axially aligned with and around the central axis 35. The color-converting tubular structure 37 is an annulus or ring made of a light-transmitting medium doped in a first portion 38 with a first wavelength-converting material and in a second portion 40 with a second wavelength-converting material. More specifically, the first portion 38 and the second portion 40 have mating, triangular cross-sectional profiles. The thickness of the tubular structure 37 at any given point is equal to the thickness of the first portion 38 plus the thickness of the second portion 40. The adjusting rod 42 is operably connected to a proximate end of the tubular structure 37 and is used for adjusting the tubular structure 37 towards or away from the base 33.

The color adjustment means 34 also has a retaining ring 44 and a retaining ring cover 46. The retaining ring 44 has an end proximate and connected to the base 33, is made of a light-transmitting material, is axially aligned with and around the central axis 35, and guides the color-converting tubular structure 37 as it is adjusted with the adjusting rod 42 towards or away from the base 33. The retaining ring cover 46 is connected to an end of the retaining ring 44 distal from the base 33 and limits the travel of the tubular structure 37.

Additionally, in this second exemplary embodiment, the lighting system 30 also has a reflector disk 39 connected to and covering the end of the tubular structure 37 distal from the base 33. The reflector disk 39 has a reflective surface facing the LED 32. The reflector disk 39 prevents light from escaping through the top of the tubular structure 37 and redirects it into the side, wavelength-converting portion of the tubular structure 37.

Finally, in this second exemplary embodiment, the light-collecting and mixing element 36 is cup-shaped and axially aligned with and around the central axis 35 of the lighting system, the LED 32, and the tubular structure 37. The light-collecting and mixing element 36 has a closed end 45, an open end 47, and a continuous side wall 48 extending therebetween. The interior surfaces of the continuous side wall 48 are preferably reflective. The closed end 45 is proximate the base 33 and defines an opening 49 for slidingly receiving the adjusting rod 42. In this case, the adjusting rod 42 is pressure fitted with the opening 49 similar to the pressure fit described with respect to the first embodiment of FIG. 1.

In operation, the user can move the tubular structure 37 toward or away from the base 33 within the retaining ring 44 using the adjusting rod 42, while the LED 32 and its side-emitted beam remain stationary. By adjusting the position of the tubular structure 37 with respect to the LED 32, different proportions of the first portion 38 and second portion 40 of the color-converting tubular structure 37 will intersect the beam of light emitted by the LED 32. By selecting an LED 32 that emits light of a first hue having a relatively short wavelength (relatively high energy), a portion of the light of a first hue will be converted by the first wavelength-converting material of the first portion 38 of tubular structure 37. A light of the second hue is emitted that is a combination of the light of the first hue (directly from the LED 32) and the hue of the light converted by the first wavelength-converting material of the first portion 38 of the tubular structure 37. The light of a second hue passes through and a portion of the light of a second hue will be converted by the second wavelength-converting material of the second portion 40 of the tubular structure 37. A light of a third hue is emitted that is a combination of the light of the second hue and the light converted by the second wavelength-converting material of the second portion 40 of the tubular structure 37.

Similar to the light-collecting and mixing element 16 shown in FIG. 1, the light-collecting and mixing element 36 collects and mixes the emitted light, and directs the mixed light out the open end 47.

The retaining ring 44 may be substantially clear, or it may be frosted to aid in the mixing of the light. Additionally, the color-converting tubular structure 37 may also be clear, or it may be frosted to aid in the mixing of the light.

Figure 3B:
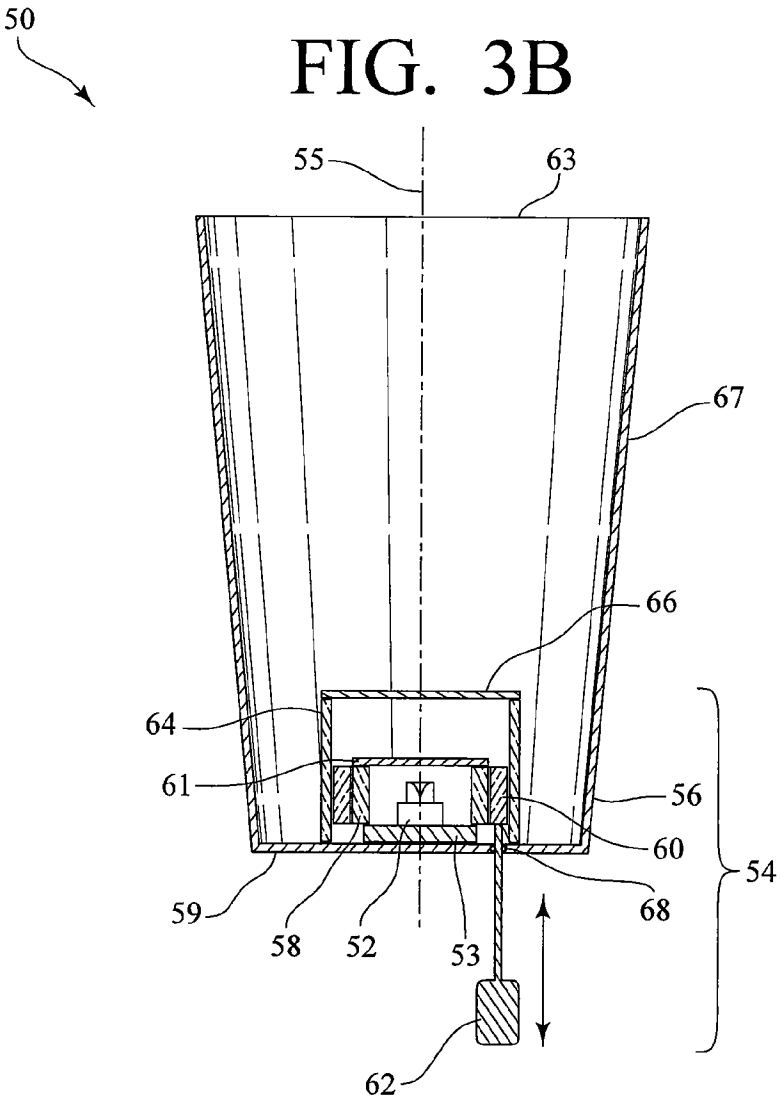
FIG. 3B is an alternate partial side-sectional view of the third exemplary embodiment of FIG. 3A.
Figure 3A:
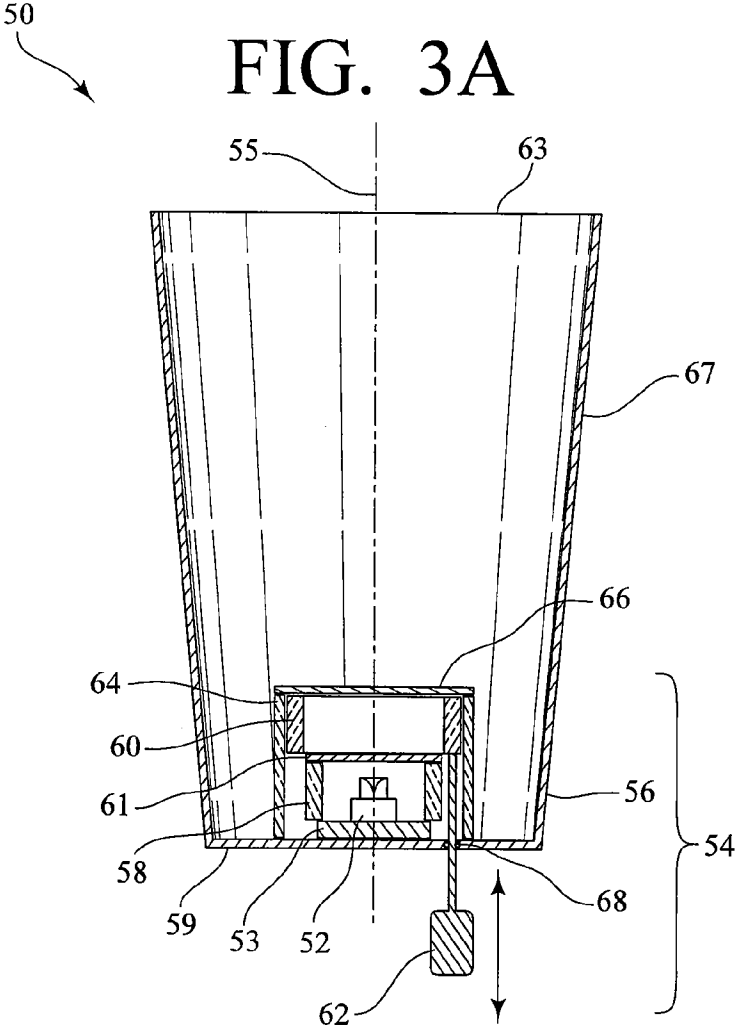
FIG. 3A is a partial side-sectional view of a third exemplary embodiment of a lighting system according to the invention.

FIG. 3A and FIG. 3B illustrate a third exemplary embodiment of a lighting system 50 according to the invention. The lighting system 50 again includes a point light source 52, a color adjustment means 54, and a light-collecting and mixing element 56.

In this third exemplary embodiment, the point light source 52 is a side-emitting LED having a base 53. The LED 52 further defines a central axis 55 of the lighting system.

In this third exemplary embodiment, the color adjustment means 54 includes a first color-converting annulus or ring 58 and a second color-converting annulus or ring 60. The color adjustment means further has a reflector disk 61, an adjusting rod 62, and a retaining ring 64. The first color-converting annulus or ring 58 has an end proximate to the base 53 and is doped with a first wavelength-converting material. The first color-converting ring 58 is also axially aligned with and around the central axis 55 and the LED 52. The second color-converting annulus or ring 60 has an end proximate to the base 53 and is further doped with a second wavelength-converting material. The second color-converting ring 60 is concentric and axially aligned with and around the first color-converting ring 58. A reflector disk 61 is connected to and covering an end of the first color-converting ring 58 distal from the base 53. The reflector disk 61 has a reflective surface facing the LED 52. The reflector disk 61 prevents light from escaping through the top of the first color-converting ring 58 and redirects it into the side, wavelength-converting portions of the color-converting rings 58, 60.

The adjusting rod 62 is operably connected to a proximate end of the second color-converting ring 60 and is used for adjusting the second color-converting ring 60 towards or away from the base 53.

The retaining ring 64 has an end proximate and connected to the base 53, is made of a light-transmitting material, is axially aligned with and around the color-converting rings 58, 60, and is used to guide the second color-converting ring 60 in the beam of the LED 52 to change the combined color output by the lighting system.

A retaining ring cover 66 is connected to an end of the retaining ring 64 distal from the base 53 and limits the travel of the second color-converting ring 60.

Finally, in this second exemplary embodiment, the light-collecting and mixing element 56 is cup-shaped and axially aligned with and around the central axis 55 of the lighting system and around the LED 52 and the color adjustment means 54. The light-collecting and mixing element 56 has a closed end 59, an open end 63, and a continuous side wall 67 extending therebetween. The interior surfaces of the continuous side wall 67 are preferably reflective. The closed end 59 is proximate the base 53 and defines an opening 68 for slidingly receiving the adjusting rod 62. In this case, the adjusting rod 62 is pressure fitted with the opening 68 similar to the pressure fit described with respect to the first embodiment of FIG. 1.

Thus, for example, FIG. 3A shows the lighting system 50 where the first color-converting ring 58 is in the light beam of the LED 52, and the second color-converting ring 60 is outside of the beam of the LED 52. By selecting an LED 52 that emits light of a first hue having a relatively short wavelength (relatively high energy), a portion of the light of a first hue will be converted by the first wavelength-converting material of the first color-converting ring 58.

Using the adjusting rod 62, the second color-converting ring 60 can be moved, as shown in FIG. 3B, into the light beam of the LED 52, such that a portion of the light of a first hue will be converted to another hue by the first wavelength-converting material of the first color-converting ring 58. A light of a second hue is emitted that is a combination of the light of the first hue (directly from the LED 52) and the hue of the light converted by the first wavelength-converting material of the first color-converting ring 58. The light of a second hue passes through and a portion will be converted to a light of yet another hue by the second wavelength-converting material of the second color-converting ring 60. A light of a third hue is emitted that is a combination of the light of the second hue and hue of the light converted by the second wavelength-converting material of the second color-converting ring 60.

Similar to the light-collecting and mixing element 16 shown in FIG. 1, the light-collecting and mixing element 56 collects and mixes the light of a first hue, the light of a second hue, and the light of a third hue, and directs the mixed light out the open end 63.

The retaining ring 64 may be substantially clear, or it may be frosted to aid in the mixing of the light. Additionally, the color-converting rings 58, 60 may also be clear, or they may be frosted to aid in the mixing of the light.

Figure 4:
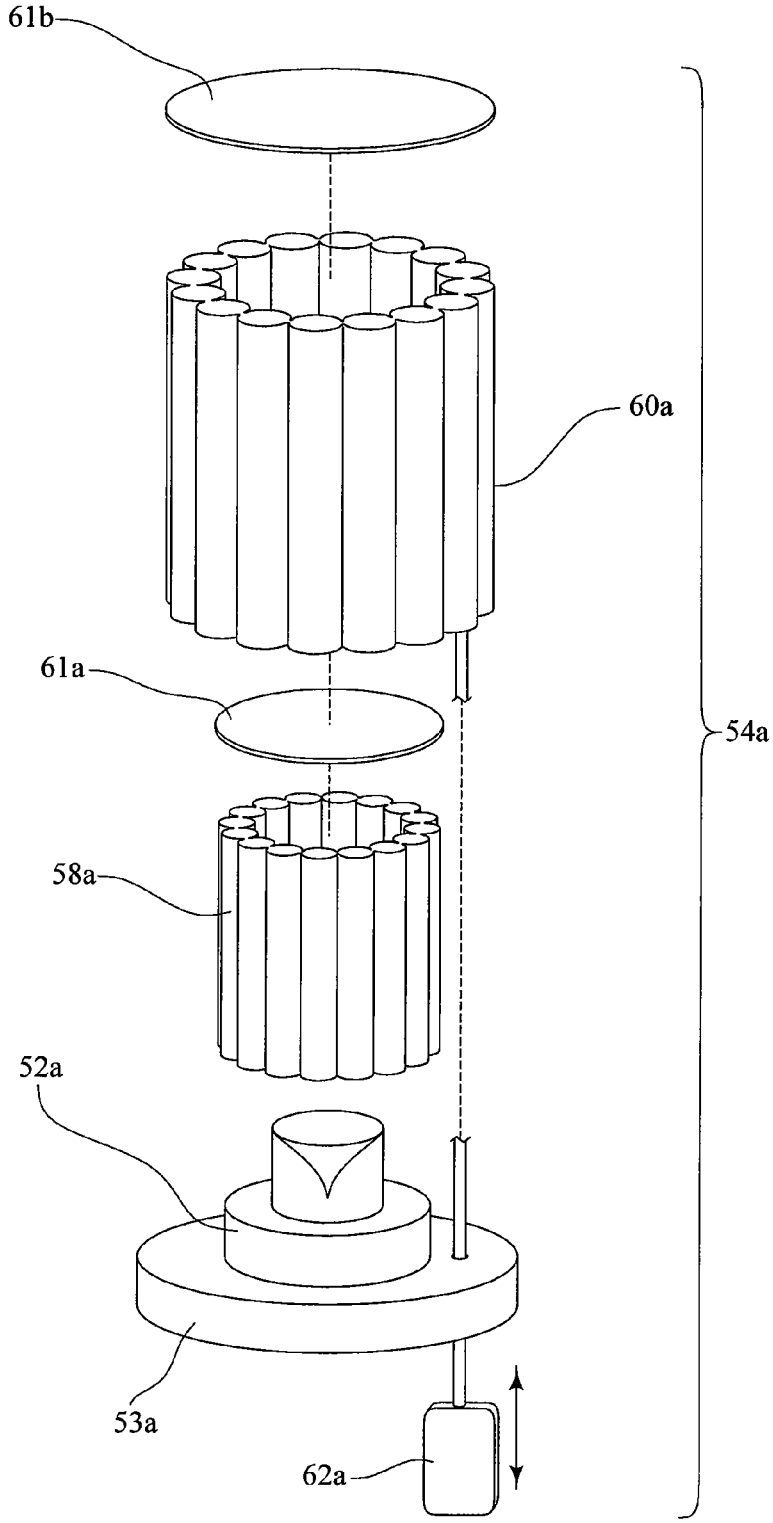
FIG. 4 is an exploded perspective view of a variation of a point light source and a color adjustment means in the third exemplary embodiment of FIG. 3A and FIG. 3B.

FIG. 4 is an exploded perspective view of a variation of a point light source and a color adjusting means in the third exemplary embodiment. The variation includes the first color-converting ring 58 and the second color-converting ring 60 of FIG. 3A and FIG. 3B. In the variation shown in FIG. 4, the first ring 58*a* and the second ring 60*a* are each formed of a plurality of light-transmitting rods arranged side-by-side to form a portion of the color adjustment means 54*a*. The light-transmitting rods of the first ring 58*a* are doped with a first wavelength-converting material, and the light-transmitting rods of the second ring 60*a* are doped with a second wavelength-converting material. In this manner, each rod 58*a* acts as a cylindrical lens with respect to the first hue, and each rod 60*a* acts as a cylindrical lens with respect to the light coming from 58*a*. Again, by selecting an LED 52*a* that emits light of a first color having a relatively short wavelength (relatively high energy), a portion of the light of a first hue will be converted to a light of another hue by the first wavelength-converting material of the first color-converting ring 58*a*.

Using a adjusting rod 62*a*, the second color-converting ring 60*a* can be moved towards or away from the base 53*a* and into the beam of the LED 52*a*, such that a portion of the light of a first hue will be converted to a light of another hue by the first wavelength-converting material of the first color-converting ring 58*a*. The emitted light will be a light of a second hue that is a combination of the light of a first hue and the light converted by the first wavelength-converting material. A portion of the light of a second hue will be converted to a light of a yet another hue by the second wavelength-converting material of the second color-converting ring 60*a*. The emitted light will be a light of a third hue. The light of the third hue is again a combination of the light of the light of the second hue and hue of the light converted by the second wavelength-converting material of the second color-converting ring 60*a*.

There are reflector disks 61*a*, 61*b* connected to and covering the end of the respective color-converting rings 58*a*, 60*a*. The reflector disks 61*a*, 61*b* each have a reflective surface facing the LED 52*a*, redirecting light into the side, wavelength-converting portion of the color-converting rings 58*a*, 60*a*.

Figure 5:
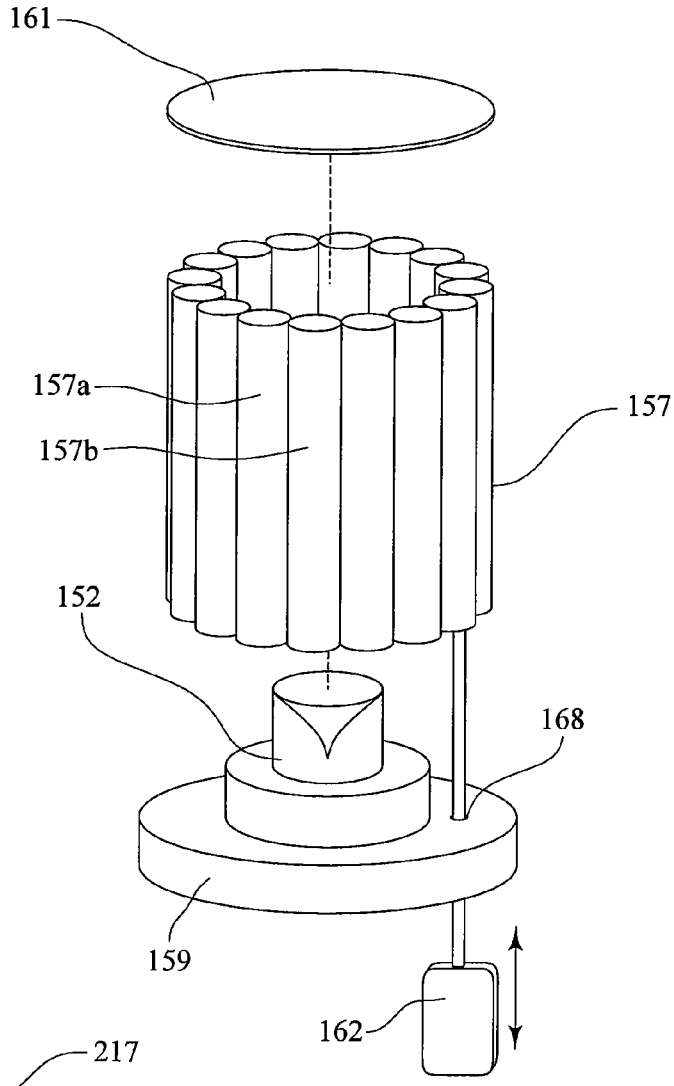
FIG. 5 is an exploded perspective view of a variation of a point light source and a color adjustment means in the second exemplary embodiment of FIG. 2.

FIG. 5 shows a tubular structure 157 formed of a plurality of light-transmitting rods arranged side-by-side to form a color-converting ring. Advantageously, some first rods 157*a* are doped with a first wavelength-converting material and some second rods 157*b* are doped with a second wavelength-converting material, such as a phosphorescent and/or fluorescent dye or pigment. Further, the tubular structure 157 is arranged by alternating first rods 157*a* with second rods 157*b*.

The tubular structure 157 is also again axially aligned with and around an LED 152 such that light of a first hue emitted by the LED 152 will pass through the tubular structure 157, and at least a portion of the light emitted by the LED 152 will be converted to a light of a second hue by the first rods 157*a* and at least a portion of the light emitted by the LED 152 will be converted to a light of a third hue by the second rods 157*b*. By using a phosphorescent and/or fluorescent dye or pigment, or a combination thereof, as the wavelength-converting material, the conversion of the light to lights of a second hue and a third hue is accomplished very efficiently, as opposed to a typical color filter which accomplishes a color change by blocking the undesired wavelengths of the emitted light. Preferably, an LED 152 emitting light having a relatively short wavelength (relatively high energy) is chosen to allow excitation of the phosphorescent and/or fluorescent dye or pigment and emission of the lights of the second and third colors having a relatively longer wavelength (relatively lower energy).

Additionally, the tubular structure 157 also has a reflector disk 161 covering an end the tubular structure 157 distal from the LED 152. The reflector disk 161 has a reflective surface facing the LED 152. The reflector disk 161 prevents light from escaping through the top of the tubular structure 157 and redirects it into the side, wavelength-converting portion of the tubular structure 157.

Figure 6:
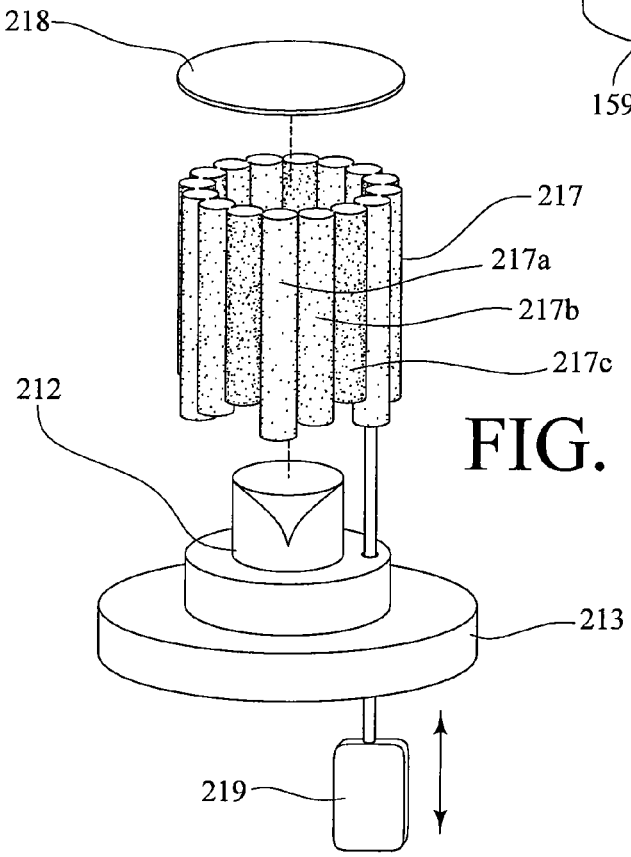
FIG. 6 is a perspective view of another variation of FIG. 2.

FIG. 6 is an exploded perspective view of an variation of FIG. 2. In the variation shown, the tubular structure 217 is formed of a plurality of light-transmitting rods arranged side-by-side to form a color-converting ring. Additionally, some first rods 217*a* are doped with a first wavelength-converting material, some second rods 217*b* are doped with a second wavelength-converting material, and some third rods 217*c* are doped with a third wavelength-converting material. Advantageously, some of the rods are of different lengths such that the ends of the arrangement are "staggered." For example, a first rod 217*a* of a first length is adjacent a second rod 217*b* of a second length, which is adjacent to a third rod 217*c* of a third length. In this staggered arrangement, the rods 217*a*, 217*b*, 217*c* alternate in wavelength converting material. The staggered rods 217*a*, 217*b*, 217*c* allow some light from an LED 212 to escape without passing through the tubular structure 217.

The tubular structure 217 is also again axially aligned with and around the LED 212, such that light of a first hue emitted by the LED 212 will pass through the tubular structure 217, and at least a portion of the light emitted by the LED 212 will be converted to a light of a second hue by the first rods 217*a* doped with a first wavelength-converting material, at least a portion of the light emitted by the LED 212 will be converted to a light of a third hue by the second rods 217*b* doped with the second wavelength-converting material, and at least a portion of the light emitted by the LED 212 will be converted to a light of a fourth hue by the third rods 217*c* doped with the third wavelength-converting material. By using a phosphorescent and/or fluorescent dye or pigment, or a combination thereof, as the wavelength-converting material, the conversion of the light to lights of a second, third, and fourth hues is accomplished very efficiently, as opposed to a typical color filter which accomplishes a color change by blocking the undesired wavelengths of the emitted light. Preferably, an LED 212 emitting light having a relatively short wavelength (relatively high energy) is chosen to allow excitation of the phosphorescent and/or fluorescent dye or pigment and emission of the lights of the second and third colors having a relatively longer wavelength (relatively lower energy).

Additionally, the tubular structure 217 again has a reflector disk 218 connected to and covering an end of the tubular structure 217 distal from a base 213. The reflector disk 218 again has a reflective surface facing the LED 212. The reflector disk 218 again prevents light from escaping through the top of the tubular structure 217 and redirects it into the side, wavelength-converting portion of the tubular structure 217.

It should also be noted that in the embodiment described with respect to FIG. 6, all of the rods could be doped with the same wavelength-converting material.

Figure 7:
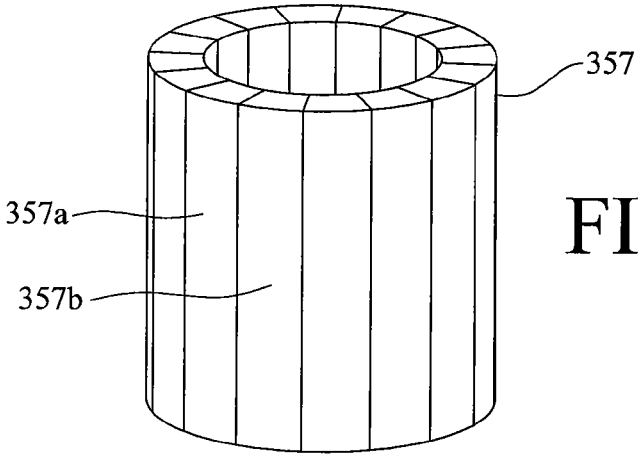
FIG. 7 is a perspective view of yet another variation of FIG. 2.

FIG. 7 is a perspective view of another variation of FIG. 2. In the variation shown, the tubular structure 357 is formed of a plurality of light-transmitting wedges arranged side-by-side to form a color-converting ring. Advantageously, some first wedges 357*a* are doped with a first wavelength-converting material and some second wedges 357*b* are doped with a second wavelength-converting material, such as a phosphorescent and/or fluorescent dye or pigment. Further, the tubular structure 357 is arranged by alternating first wedges 357*a* with second wedges 357*b*. Otherwise, the wedges operate similarly as the rods.

Figure 8:
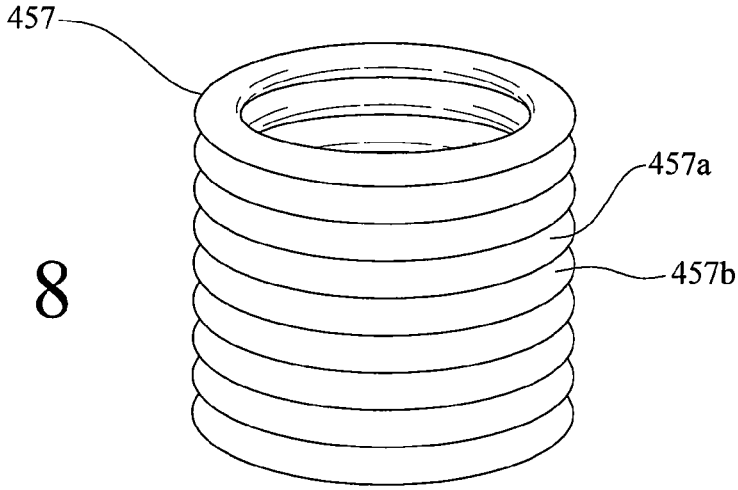
FIG. 8 is an exploded perspective view of yet another variation of FIG. 2.

FIG. 8 is a perspective view of yet another variation of FIG. 2. In the variation shown, the tubular structure 457 is formed of a plurality of light-transmitting toroids arranged side-by-side to form a color-converting ring. Advantageously, some first toroids 457*a* are doped with a first wavelength-converting material and some second toroids 457*b* are doped with a second wavelength-converting material, such as a phosphorescent and/or fluorescent dye or pigment. Further, the tubular structure 457 is arranged by alternating first toroids 457*a* with second toroids 457*b*. Otherwise, the toroids operate similarly as the rods and the wedges.

Figure 9:
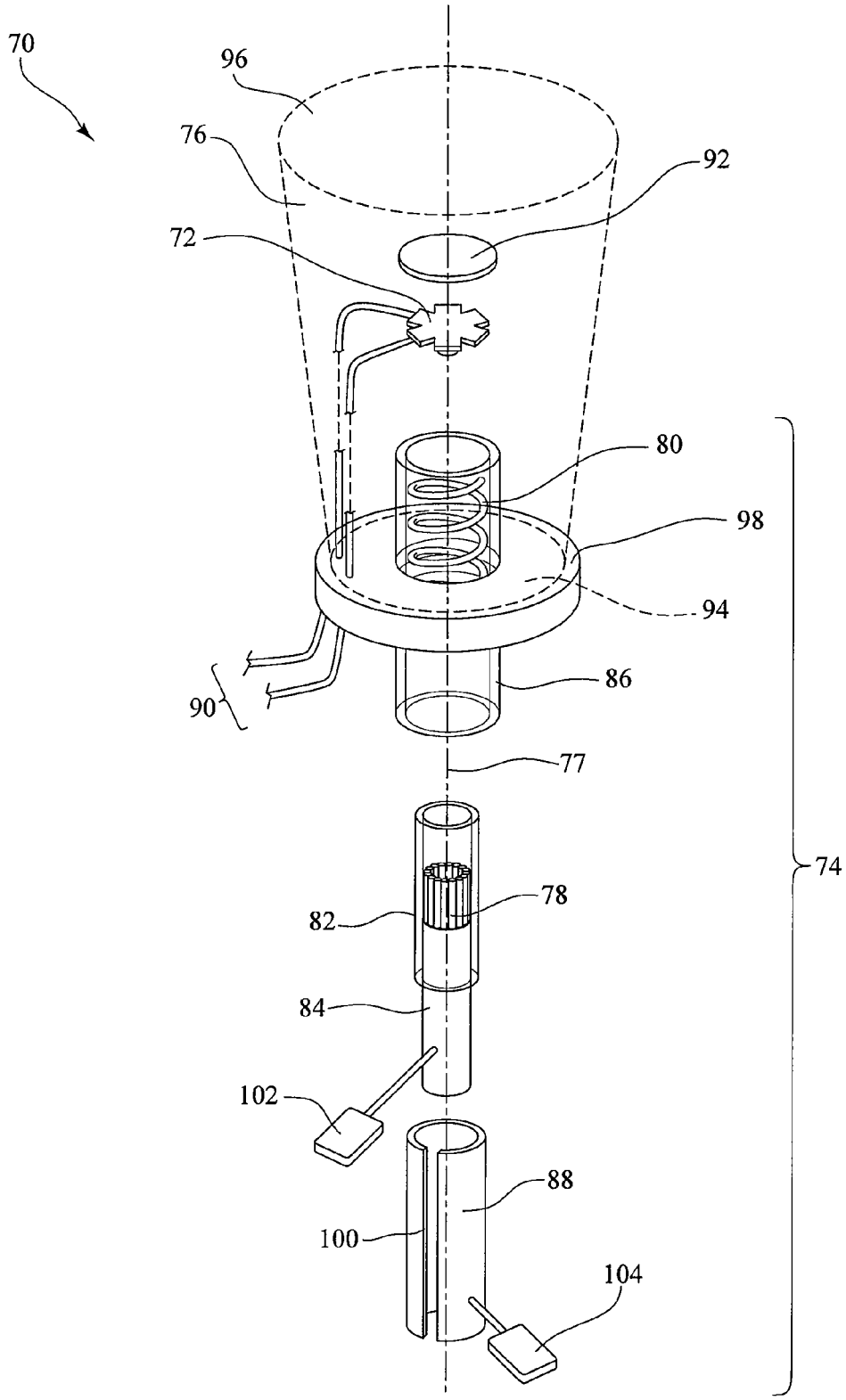
FIG. 9 is an exploded perspective view of a fourth exemplary embodiment of a lighting system according to the invention.

FIG. 9 is a fourth exemplary embodiment of a lighting system 70 according to the invention. As shown, the lighting system 70 again includes an LED 72, a color adjustment means 74, and a light collecting and mixing element 76.

Similar to the other embodiments, the LED 72 is a side-emitting LED having a base 92 that emits light of a first hue and further defines a central axis 77. Also shown are electrical leads 90 for supplying power to the LED 72, and a base 92 that acts as a heat sink for dissipating heat from the LED 72.

However, in the fourth exemplary embodiment, the color adjustment means 74 is comprised of a first color-converting light-transmitting tubular structure 78, a first color-converting helical fiber 80, a first light-transmitting tube 82, a cylindrical plunger 84, a second light-transmitting tube 86, and a tubular plunger 88.

The tubular structure 78 is a color-converting ring formed of a plurality of light-transmitting rods arranged side-by-side to form the tubular structure 78. The tubular structure 78 is positioned between the base 92 and the cylindrical plunger 84. The light-transmitting rods of the tubular structure 78 are doped with a first wavelength-converting material.

The color-converting helical fiber 80 is a light-transmitting fiber formed in the shape of a cylindrical coil, spiral, or helix. The helical fiber 80 has a diameter that is larger than the diameter of the tubular structure 78. The helical fiber 80 is positioned around and is axially aligned with the LED and with the tubular structure 78 and is further positioned between the base 92 and the tubular plunger 88. The helical fiber 80 is doped with a second wavelength-converting material.

The first light-transmitting tube 82 is dimensioned to fit between the tubular structure 78 and the helical fiber 80. The diameter of the cylindrical plunger 84 is slightly smaller than the inner diameter of the first light-transmitting tube 82. The cylindrical plunger 84 is slidingly received within the first light-transmitting tube 82 with one end of the cylindrical plunger 84 attached to one end of the tubular structure 78. The tubular structure 78 is positioned within the first light-transmitting tube 82 such that it can be adjustably moved into and out of the beam of the LED 72 through activation of the cylindrical plunger 84.

The inner diameter of the second light-transmitting tube 86 is slightly larger than the diameter of the helical fiber 80. The second light-transmitting tube 86 is positioned around the helical fiber 80. The diameter of the tubular plunger 88 is substantially the same as the diameter of the helical fiber 80. The tubular plunger 88 is slidingly received between the second light-transmitting tube 86 and the first light-transmitting tube 82 with one end of the tubular plunger 88 adjacent one end of the helical fiber 80. The helical fiber 80 is positioned between the first light-transmitting tube 82 and the second light-transmitting tube 86 around the light-emitting portion of the LED 72 and between the base 92 of the LED 72 and the tubular plunger 88.

The light-collecting and mixing element 76 is cup-shaped and receives at least the LED 72, the tubular structure 78, and the helical fiber 80 in its cup-shaped cavity. The light-collecting and mixing element 76 is for collecting and mixing light from the LED 72, the tubular structure 78 and the helical fiber 80. The light-collecting and mixing element 76 has a closed end 94 and an open end 96. The closed end 94 may be formed from a reflecting plate 98 having a reflective interior surface. The closed end 94 may further have an opening sized for allowing the second light-transmitting tube 86 to protrude through the closed end 94 and into the interior of the light-collecting and mixing element 76 and for holding the second light-transmitting tube 86 in a fixed position.

Preferably, the tubular plunger 88 also has a longitudinal slot 100, for allowing support structure (not shown) to extend between the second light-transmitting tube 86 and the first light-transmitting tube 82, in order to hold the first light-transmitting tube 82 in a fixed position.

In operation, the LED 72 emits light of a first hue. A portion of the emitted light passes through the tubular structure 78 and the helical fiber 80. A portion of the emitted light is received by the tubular structure 78 and converted to a light of another hue. A portion of the emitted light is received by the helical fiber 80 and converted to a light of yet another hue. The light-collecting and mixing element 76 collects and mixes the light of a first hue, the light converted by the tubular structure, and the light converted by the helical fiber, and directs the mixed light out the open end 96 of the light-collecting and mixing element 76.

Advantageously, the cylindrical plunger 84 allows the tubular structure 78 to be moved toward and away from the base 92 and, thus, into and out of the beam of the LED 72. An adjusting rod 102 is attached to the cylindrical plunger 84 to assist in the movement of the cylindrical plunger 84. The tubular plunger 88 allows the open spaces between the turns of the helical fiber 80 to be adjusted by compressing or decompressing the helical fiber 80. An adjusting rod 104 is attached to the tubular plunger 88 to assist in the movement of the tubular plunger 88.

It should be noted that for any of the annulus or ring structures described in the embodiments, a toroid could also be utilized.

One of ordinary skill in the art will also recognize that additional embodiments are possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A lighting system, comprising:

a point light source having a base and emitting a light of a first hue, said point light source further defining a central axis; and a color adjustment means comprising, a first color-converting ring having an end proximate said base and further doped with a first wavelength-converting material, said first color-converting ring being axially aligned with said point light source, intersecting said light of said first hue emitted by said point light source, converting at least a portion of said light of said first hue, and emitting a light of a second hue that is a combination of the light of said first hue and the hue of the light converted by the first wavelength-converting material;

a first reflector disk connected to a distal end of said first color-converting ring;

a second color-converting ring having an end proximate said base, said second color-converting ring being doped with a second wavelength-converting material, said second color-converting ring being concentric and axially aligned with said first color-converting ring;

an adjusting rod operably connected to and for adjusting said second color-converting ring toward or away from said base, such that said second color-converting ring adjustably intersects said light of said second hue, converts at least a portion of said light of said second hue to a light of another hue, and emits a light of a third hue that is a combination of said light of said second hue and the hue of the light converted by the second wavelength-converting material.

2. The lighting system of claim 1, wherein said color adjustment means further includes:

a retaining ring being axially aligned with said point light source and further housing said color-converting rings for guiding said second color-converting ring as it is moved toward or away from said base; and a retaining ring cover connected to a distal end of said retaining ring for limiting a travel of said second color-converting ring.

3. The lighting system of claim 2, wherein said retaining ring is clear.

4. The lighting system of claim 2, wherein said retaining ring is frosted to aid in the mixing of said light.

5. The lighting system of claim 1, wherein said first color-converting ring is formed of a first plurality of light-transmitting rods arranged side-by-side; and wherein said second color-converting ring is formed of a second plurality of light-transmitting rods arranged side-by-side.

6. The lighting system of claim 5, wherein said color adjustment means further includes:

a second reflector disk connected to a distal end of said second color-converting ring.

7. The lighting system of claim 1, wherein said point light source is a light-emitting diode.

8. The lighting system of claim 1, wherein said point light source is an ultraviolet light source.

9. The lighting system of claim 1, wherein said point light source is a metal halide light source.

10. The lighting system of claim 1, and further comprising a mixing element that is substantially cup-shaped and axially aligned with said point light source, and further having a closed end being proximate said point light source, an open end being distal said point light source, and a continuous side wall extending therebetween for collecting, mixing, and emitting light toward said open end.

* * * * *